US011015483B2

(12) United States Patent
K et al.

(10) Patent No.: US 11,015,483 B2
(45) Date of Patent: May 25, 2021

(54) HIGH PRESSURE COMPRESSOR FLOW PATH FLANGES WITH LEAK RESISTANT PLATES FOR IMPROVED COMPRESSOR EFFICIENCY AND CYCLIC LIFE

(71) Applicant: General Electric Company, Schenectady, NY (US)

(72) Inventors: Vishnu Das K, Bangalore (IN); Carlos Ivan Flores, West Chester, OH (US); Atanu Saha, Bangalore (IN); Vinaykumar Shrimantrao Patil, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 403 days.

(21) Appl. No.: 15/916,811

(22) Filed: Mar. 9, 2018

(65) Prior Publication Data

US 2019/0277161 A1 Sep. 12, 2019

(51) Int. Cl.
*F01D 25/24* (2006.01)
*F01D 11/00* (2006.01)

(52) U.S. Cl.
CPC ..... *F01D 25/243* (2013.01); *F01D 11/005* (2013.01); *F05B 2240/14* (2013.01); *F05D 2240/55* (2013.01)

(58) Field of Classification Search
CPC ..... F01D 25/24; F01D 25/243; F01D 11/005
See application file for complete search history.

(56) References Cited

U.S. PATENT DOCUMENTS

| | | | | |
|---|---|---|---|---|
| 4,199,175 | A | 4/1980 | Paukune | |
| 4,815,933 | A | 3/1989 | Hansel et al. | |
| 5,219,268 | A | 6/1993 | Johnson | |
| 6,283,712 | B1 * | 9/2001 | Dziech | F01D 5/066 415/115 |
| 6,951,109 | B2 | 10/2005 | Lemon et al. | |
| 8,911,212 | B2 * | 12/2014 | Delapierre | F01D 5/066 416/204 A |
| 9,512,724 | B2 | 12/2016 | Delapierre et al. | |
| 2011/0008165 | A1 * | 1/2011 | Ottow | F01D 25/243 415/213.1 |
| 2012/0133102 | A1 * | 5/2012 | Samudrala | F16J 15/0812 277/654 |

(Continued)

*Primary Examiner* — Ninh H. Nguyen
*Assistant Examiner* — Cameron A Corday
(74) *Attorney, Agent, or Firm* — Hanley, Flight & Zimmerman, LLC

(57) ABSTRACT

Various embodiments include a compressor casing and a method of assembly. The compressor casing comprises a first and an adjacent, second annular casing segments each comprising an annular radially-extending flange with mounting holes; at least one annular recess disposed on at least one annular side mating face of the adjacent flanges of the adjacent segments; at least one set of stress-relief holes disposed through at least one flange of the adjacent segments; and at least one annular leak-resistant plate disposed within the at least one annular recess having at least a third set of mounting holes. All sets of mounting holes are substantially aligned with each other and receive a plurality of respective fasteners, and the at least one annular plate is clamped between the adjacent segments and seals the at least one set of stress-relief holes for preventing leakage therethrough.

15 Claims, 7 Drawing Sheets

(56) References Cited

U.S. PATENT DOCUMENTS

| | | | | |
|---|---|---|---|---|
| 2015/0226125 | A1* | 8/2015 | Petty | F01D 25/162<br>60/796 |
| 2016/0265375 | A1* | 9/2016 | Maret | F16J 15/3472 |
| 2016/0369648 | A1 | 12/2016 | Otto et al. | |
| 2016/0376901 | A1 | 12/2016 | O'Leary et al. | |

* cited by examiner

HIGH PRESSURE COMPRESSOR FLOW PATH FLANGES WITH LEAK RESISTANT PLATES FOR IMPROVED COMPRESSOR EFFICIENCY AND CYCLIC LIFE

FIELD

This disclosure relates generally to compressors in gas turbine engines, and more particularly relates to a compressor casing in such compressors.

BACKGROUND

A gas turbine engine includes, in serial flow communication, a compressor, a combustor, and a turbine. The turbine is mechanically coupled to the compressor and the three components define a turbomachinery core. The core is operable in a known manner to generate a flow of hot, pressurized combustion gases or products to operate the engine as well as perform useful work such as providing propulsive thrust or mechanical work.

The compressor of the engine may comprise a booster and a high-pressure compressor or "HPC" arranged in serial flow relationship. The high-pressure compressor comprises a plurality of casing joints with hot gas path flanges or radially-extending flanges, and adjacent flanges comprise a plurality of bolt holes or threaded holes for respective bolts or screws passing through and connecting together. The cyclic life of the bolt holes and the casing joints is substantially influenced by high temperature and high pressure of the flow of the compressed air, and cannot be improved by altering the basic flange geometry or size, since the flanges are primarily sized for blade tip clearances.

For improving the cyclic life of the bolt holes and resultant casing joints, one or more stress-relief holes are introduced into the radially-extending flanges to reduce hoop stress. But the stress-relief holes probably result in additional leakage through flange mating/seating surfaces, which affects the blade tip clearances and increases the risk of rubs and causes the casing joints to respond thermally faster, thus would require opening up the operating clearances and increase Specific Fuel Consumption (SFC).

For reducing hoop stress and leakage, the density or the amounts of the bolt holes may be improved, thus hoop stress is reduced accordingly and the cyclic life is improved and lesser leakage is achieved than with the stress-relief holes. But this results in higher weight (in turn adversely affecting the SFC) due to increased bolt counts.

It is desirable to achieve the compressor casing or casing joints with high cyclic life and low SFC. The present disclosure aims to achieve the compressor casing or casing joints with high cyclic life and low SFC.

BRIEF DESCRIPTION OF THE DISCLOSURE

According to one aspect of the disclosure, a compressor casing comprises a first annular casing segment comprising a first annular radially-extending flange at a first end thereof, and the first flange comprises a first set of mounting holes. The compressor casing further comprises a second annular casing segment adjacent to the first segment, and the second segment comprises a second annular radially-extending flange at a second end thereof, and is configured to connect to the first flange of the first segment during assembly, and the second flange comprises a second set of mounting holes. The compressor casing further comprises at least one annular recess disposed on at least one annular side mating face of the first flange of the first segment and the second flange of the second segment. The compressor casing further comprises at least one set of stress-relief holes disposed through at least one of the first flange of the first segment and the second flange of the second segment. The compressor casing further comprises at least one annular leak-resistant plate configured to be disposed within the at least one annular recess, and the at least one annular leak-resistant plate comprises at least a third set of mounting holes. The first set of mounting holes, the second set of mounting holes, and the at least the third set of mounting holes are configured to be aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus prevents leakage from a gas flow path within the compressor casing through the at least one set of stress-relief holes.

According to another aspect of the disclosure, a gas turbine engine apparatus comprises a compressor, a combustor, and a turbine arranged in serial flow relationship. The compressor comprises an annular compressor casing. The annular compressor casing comprises a first annular casing segment comprising a first annular radially-extending flange at a first end thereof, and the first flange comprises a first set of mounting holes. The annular compressor casing further comprises a second annular casing segment adjacent to the first segment comprising a second annular radially-extending flange at a second end thereof, and the second flange comprises a second set of mounting holes and is configured to connect to the first flange of the first segment during assembly. The annular compressor casing further comprises at least one annular recess disposed on at least one annular side mating face of the first flange of the first segment and the second flange of the second segment. The annular compressor casing further comprises at least one set of stress-relief holes disposed through at least one of the first flange of the first segment and the second flange of the second segment. The annular compressor casing further comprises at least one annular leak-resistant plate configured to be disposed within the at least one annular recess, and the at least one annular leak-resistant plate comprises at least a third set of mounting holes. The first set of mounting holes, the second set of mounting holes, and the at least the third set of mounting holes are configured to be aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus prevents leakage from a gas flow path within the compressor casing through the at least one set of stress-relief holes.

According to another aspect of the disclosure, a method of assembling a compressor casing comprises providing a first annular casing segment of the compressor casing, wherein the first segment comprises a first annular radially-extending flange at a first end thereof, and the first flange comprises a first set of mounting holes. The method further comprises mounting the first segment in a respective position in a compressor with a second end opposite to the first end of the first segment. The method further comprises placing a second annular casing segment adjacent to the first flange of the first segment, wherein the second segment comprises a second annular radially-extending flange at a second end thereof, and the second flange comprises a second set of mounting holes and is configured to connect to the first flange of the first segment. The method further comprises providing at least one annular recess on at least one annular side mating face of the first flange of the first segment and the second flange of the second segment. The method further comprises placing at least one annular leak-resistant plate in the at least one annular recess, wherein the at least one annular leak-resistant plate comprises at least a third set of mounting holes. The method further comprises substantially aligning the first set of mounting holes with the second set of mounting holes, and the at least the third set of mounting holes, and directing a plurality of fasteners axially extending therethrough, and clamping the at least one annular leak-resistant plate between the first flange of the first segment and the second flange of the second segment via the plurality of fasteners. At least one set of stress-relief holes are disposed through at least one of the first flange of the first segment and the second flange of the second segment, and the at least one annular leak-resistant plate is configured to seal the at least one set of stress-relief holes, thus prevents leakage from a gas flow path within the compressor casing through the at least one set of stress-relief holes.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The disclosure herein may be best understood by reference to the following description taken in conjunction with the accompanying drawing figures in which.

DETAILED DESCRIPTION OF THE DISCLOSURE

Figure 1:
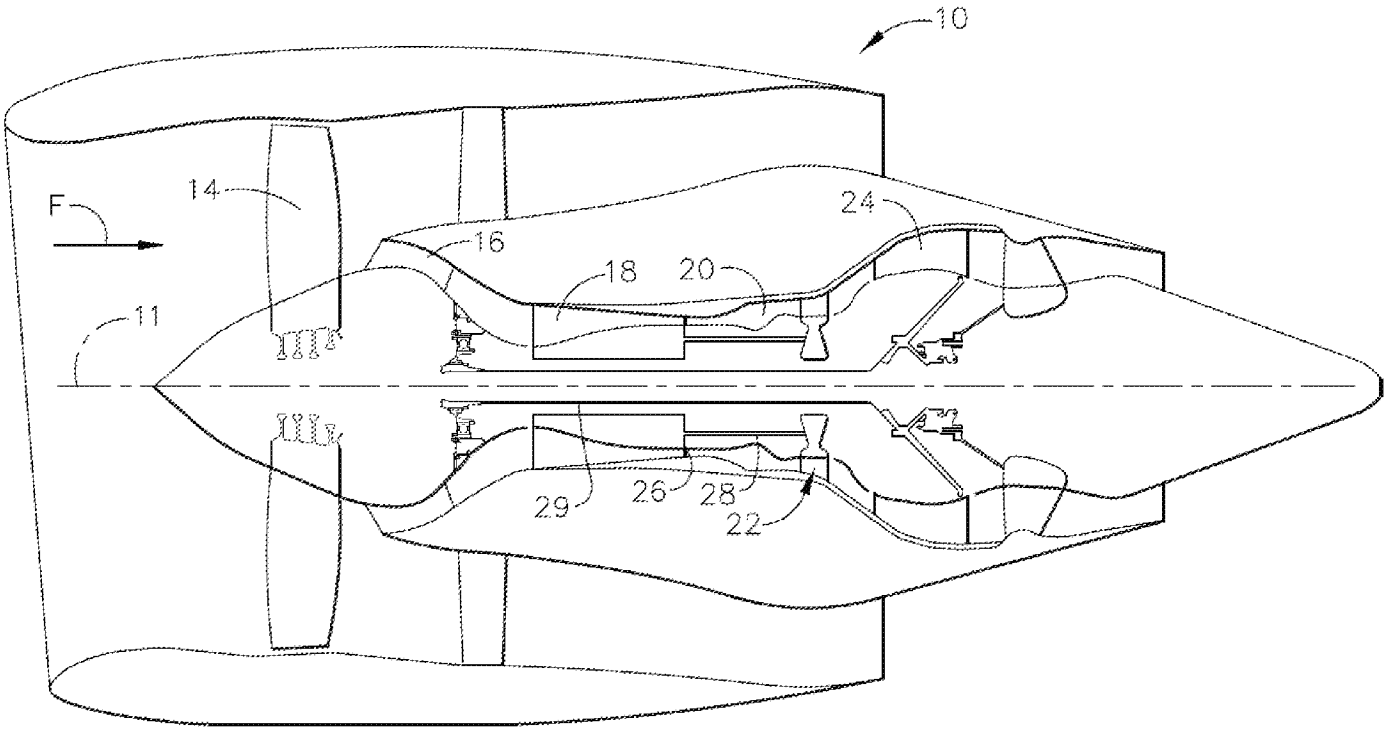
FIG. 1 is a schematic, cross-sectional view of a gas turbine engine that incorporates a compressor.

Reference will now be made in detail to present embodiments of the disclosure, one or more examples of which are illustrated in the accompanying drawings. The detailed description uses numerical and letter designations to refer to features in the drawings. Referring to the drawings wherein identical reference numerals denote the same elements throughout the various views.

FIG. 1 shows an exemplary gas turbine engine 10. While the illustrated example is a high-bypass turbofan engine, the principles of the present disclosure are also applicable to other types of engines, such as low-bypass turbofans, turbojets, turboprops, etc., as well as turbine engines having any number of compressor-turbine spools. The engine 10 has a longitudinal center line or longitudinal axis 11.

It is noted that, as used herein, the terms "axial", "axially" and "longitudinal" refer to a direction parallel to the longitudinal axis 11, while the term "radial" or "radially" refers to a direction perpendicular to the axial direction, and the term "circumferentially" refers to the relative direction that extends around the longitudinal axis 11. The terms "upstream" and "downstream" refer to the relative direction with respect to fluid flow in a fluid pathway. For example, "upstream" refers to the direction from which the fluid flows, and "downstream" refers to the direction to which the fluid flows. The flow or fluid direction is indicated by the arrow "F" in FIG. 1. These directional terms are used merely for convenience in description and do not require a particular orientation of the structures described thereby.

The engine 10 has a fan 14, a booster 16, a high-pressure compressor or "HPC" 18, a combustor 20, a high pressure turbine or "HPT" 22, and a low pressure turbine or "LPT" 24 arranged in serial flow relationship. In operation, pressurized air from an exit 26 of the compressor 18 is mixed with fuel in the combustor 20 and ignited, thereby generating combustion gases. Some work is extracted from these gases by the high pressure turbine 22 which drives the compressor 18 via an outer shaft 28. The combustion gases then flow into the low pressure turbine 24, which drives the fan 14 and booster 16 via an inner shaft 29.

The compressor 18 includes a number of stages of blading and a compressor casing; for example, a typical compressor could include 6-14 stages. In operation, the static air pressure is incrementally increased by each subsequent compressor stage, with the final stage discharging air at the intended compressor discharge pressure ("CDP") for subsequent flow into the combustor 20. Each compressor stage represents the investment of incrementally more mechanical work. The illustrated example shows axial stages, but the principles described herein are also applicable to centrifugal or axil-centrifugal compressors.

Figure 2:
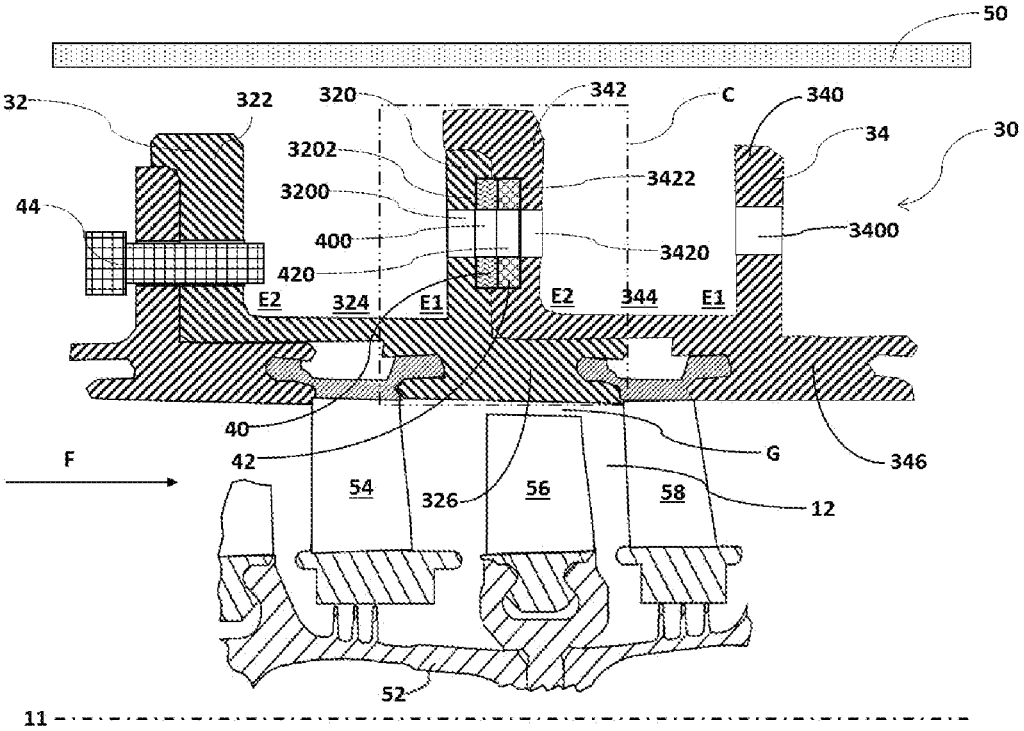
FIG. 2 is a schematic, half-sectional view of a compressor casing of a compressor of the engine of FIG. 1, in accordance with an embodiment of the disclosure.

FIG. 2 shows a half-sectional view of a portion of the compressor 18 incorporating an exemplary embodiment of a compressor casing 30. The compressor casing 30 is configured to be disposed radially within an annular outer wall 50 and surround a plurality of compressor stages consisting of stator vanes and rotor blades and form the gas flow path 12 therein. As illustrated in FIG. 2, a row of circumferentially-spaced airfoil-shaped rotor blades 56 are mechanically coupled to a compressor rotor 52 which is in turn mechanically coupled to the outer shaft 28 described above, and a first row of circumferentially-spaced, stationary airfoil-shaped stator vanes 54 and a second row of circumferentially-spaced, stationary airfoil-shaped stator vanes 58 are supported by the compressor casing 30 and disposed upstream and downstream of the row of rotor blades 56, respectively. Stator vanes 54, 58 are mounted in the compressor casing 30 via any traditional connecting devices, such as wing shaped hooks or flanges and so on.

The compressor casing 30 comprises a plurality of compressor annular casing segments or a plurality of annular casing segments. For simplifying illustration and description, only two completed or whole adjacent compressor annular casing segments of the compressor casing 30 are shown in FIG. 2, and the amount or the number of the compressor annular casing segments in the compressor casing 30 may vary and be determined based on actual requirements and/or operational conditions and so on. For the purposes of description, one of the segments will be referred to as "a first or an upstream compressor annular casing segment" 32 relative to the flow direction indicated by the arrow F and the other segment downstream of the first segment 32 will be referred to as "a second or a downstream compressor annular casing segment" 34. It will be further understood that both of the first and the second compressor annular casing segments 32, 34 would be located upstream of the exit 26 of the compressor 18. Each annular casing segment comprises a plurality of grooves for connectors of stator vanes 54, 58 to install or insert into.

As shown in FIG. 2, the exemplary first annular casing segment 32 comprises a first and a second annular, radially-extending flanges 320, 322 respectively disposed at a first end E1 and a second end E2 thereof and extending therefrom, the first segment 32 further comprises a first and a second annular axially-extending bodies 324, 326 from which the first and the second flanges 320, 322 extend radially outward respectively, the first body 324 extends axially between the first end E1 and the second end E2 of the first segment 32, and the second body 326 extends axially away from the first flange 320 and may be disposed radially inside of the first body 324. The first flange 320 comprises a first set of mounting holes 3200 axially defined therethrough and a first annular recess 3202 formed on an annular side mating face S1 (shown in FIG. 3) of the first flange 320. In other embodiments, the relative radial position between the first body and the second body of the first segment 32 may be varied as desired, for example, the second body may be disposed radially outside of the first body or both of them are radially aligned.

Similarly, the second segment 34 is configured to be adjacent to and used for connecting to the first segment 32, and the second segment 34 comprises a first and a second annular, radially-extending flange 340, 342 disposed at a first end E1 and a second end E2 thereof and extending therefrom. The second segment 34 further comprises a first and a second annular axially-extending bodies 344, 346 from which the first and the second flanges 340, 342 extend radially outward respectively, and the first body 344 extends axially between the first end E1 and the second end E2 of the second segment 34, and the second body 346 extends axially towards downstream away from the first end E1 or the first flange 340 thereof. The second flange 342 of the second segment 34 is used for connecting to the first end E1 of the first segment 32 during assembly, specifically connecting to the first flange 320. The second flange 342 comprises a second set of mounting holes 3420 axially therethrough and a second annular recess 3422 formed on an annular side mating face S2 (shown in FIG. 3) of the second flange 342.

For simplifying illustration and description, all components within a dashed line box shown in FIG. 2 are collectively called as a casing (or fixed) joint or connection C of the compressor casing 30, the exemplary casing joint C comprises a first annular leak-resistant plate 40 and a second annular leak-resistant plate 42 configured to be respectively disposed within the first annular recess 3202 and the second annular recess 3422, and the first and the second annular leak-resistant plates 40, 42 comprise a third and a fourth sets of mounting holes 400, 420, respectively. In other embodiments, each casing joint C of the compressor casing 30 may comprise single annular leak-resistant plate, but more than two annular leak-resistant plates may be used based on practical requirements or operation or manufacturing conditions.

As shown in FIG. 2, the exemplary casing joint C comprises the first flange 320 and the second flange 342 and the first and the second annular leak-resistant plates 40, 42 and the fasteners 44 and at least part of the first and the second bodies 324, 326 of the first segment 32 and part of the first body 344 of the second segment 34. At least one set of stress-relief holes may be disposed through at least one of the first flange 320 of the first segment 32 and the second flange 342 of the second segment 34, i.e. the set(s) of stress-relief holes may be formed in one or both of the first flange 320 and the second flange 342 based on hoop stress requirements, and/or other manufacture or operation conditions.

Figure 8:
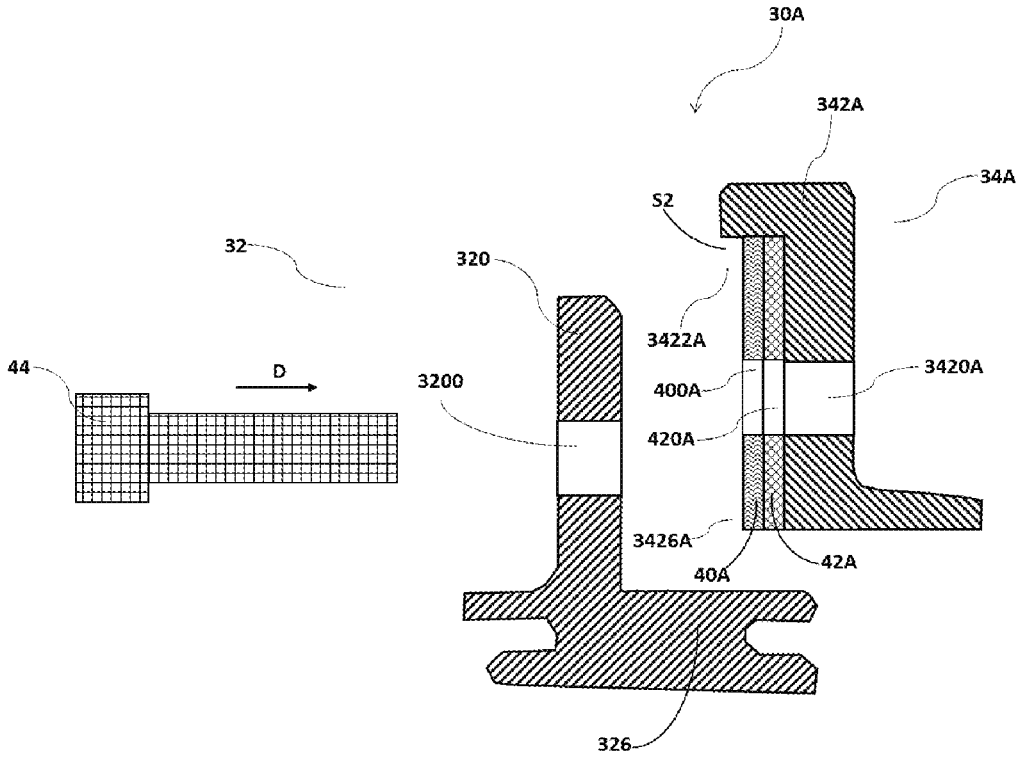
FIG. 8 are a schematic, half-sectional exploded view of a casing joint of the compressor casing, in accordance with another embodiment of the disclosure.
Figure 9:
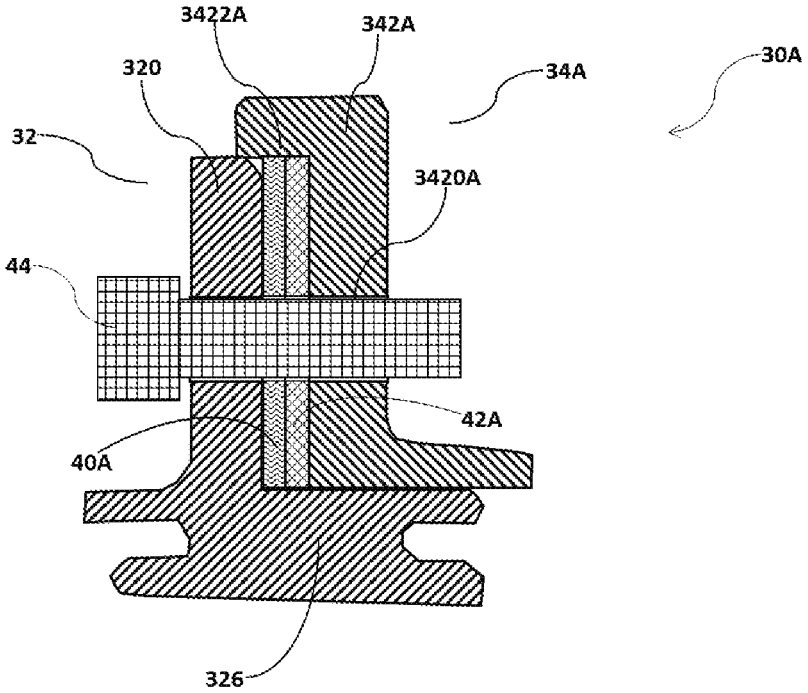
FIGS. 9 and 10 are schematic, half-sectional views of a casing joint of the compressor casing shown in FIG. 8, taken at the same axial positions and at different circumferential positions relative to the longitudinal axis of the compressor, in accordance with an embodiment of the disclosure.
Figure 10:
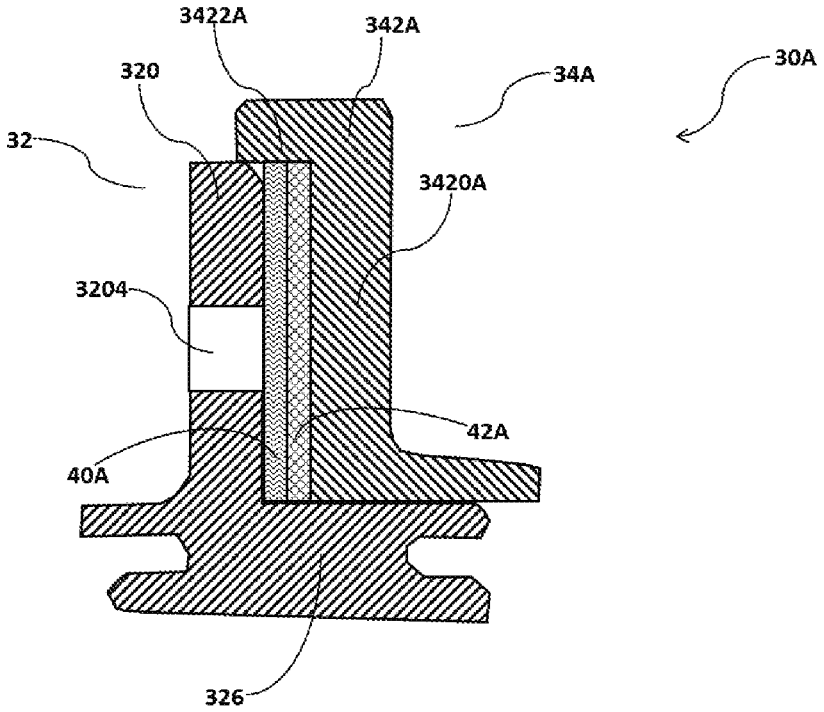

In other embodiments, each casing joint C of the compressor casing 30 may comprise single annular recess, which is illustrated in FIGS. 8-10 and below descriptions, but the number of the annular recess may also be determined based on practical or operation or manufacturing conditions or other requirements. In some embodiments, each mounting hole may have similar or same or equal size or cross-sectional area with that of each stress-relief hole. In other embodiments, the size of each mounting hole may be bigger or smaller than the size of each stress-relief hole. The actual size of the mounting hole or stress-relief hole may be determined based on practical or manufacture or operation conditions or requirements.

Figure 4:
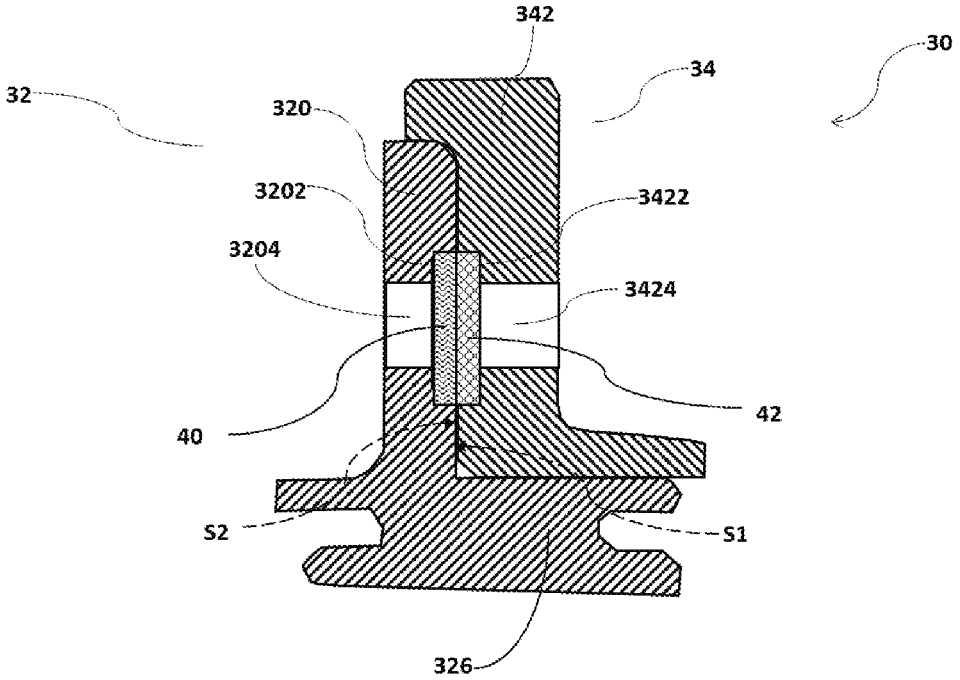

As illustrated in FIG. 4, the first flange 320 comprises a first set of stress-relief holes 3204 axially extending or defining therethrough, and the second flange 342 comprises a second set of stress-relief holes 3424 axially extending therethrough. one or more mounting holes 3200 of the first set of mounting holes 3200 are circumferentially spaced apart by one or more stress-relief holes 3204 of the first set of stress-relief holes 3204. one or more mounting holes 3420 of the second set of mounting holes 3420 are circumferentially spaced apart by one or more stress-relief holes 3424 of the second set of stress-relief holes 3424. The amounts or position or configuration of the first set of stress-relief holes 3204 is not limited to being equal to or corresponding to that of the second set of stress-relief holes 3424, which may be adjusted based on hoop stress requirements and manufacture or operation conditions.

Figure 3:
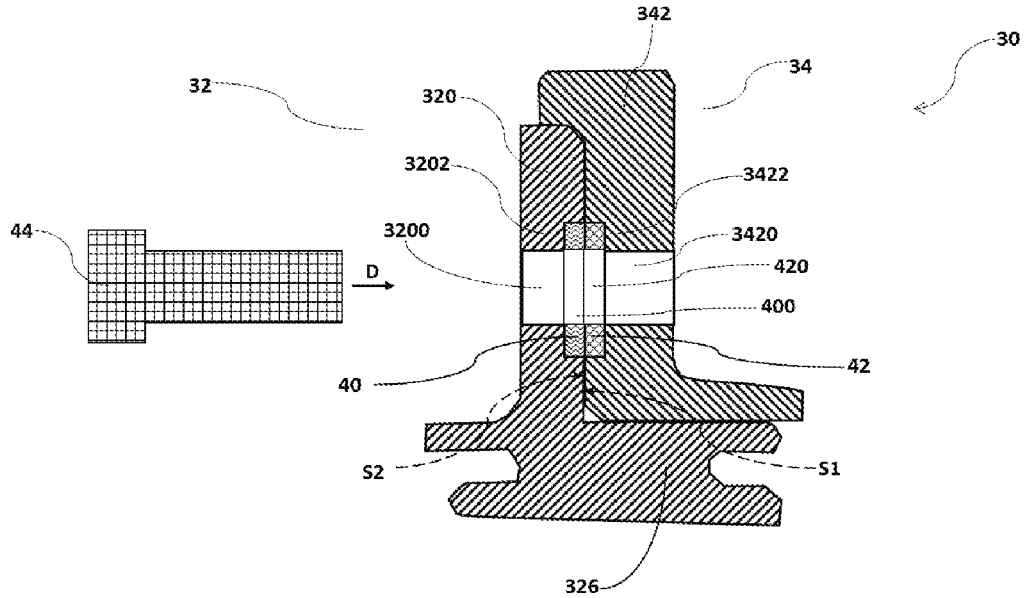
FIG. 3-5 are enlarged half-sectional views of a casing joint C of the compressor casing shown in FIG. 2, taken at the same axial positions and at different circumferential positions relative to the longitudinal axis of the compressor, in accordance with an embodiment of the disclosure.

During assembly, the first set of mounting holes 3200, the second set of mounting holes 3420, the third set of mounting holes 400 and the fourth set of mounting holes 420 are configured to be aligned with each other and all uniformly or symmetrically relative to the longitudinal axis 11 of the engine, and cooperatively receive a plurality of respective fasteners 44 axially extending therethrough in a direction indicated by arrow D in FIG. 3, the plurality of respective fasteners 44 may be blots or screws or any other fasteners common-known or used or anyone skilled in the arts could conceive.

In assembly and operation, the second body 326 of the first segment 32 is disposed radially inside of and contacts with the first body 344 of the second segment 342 relative to the longitudinal axis 11 of the engine, and the second body 326 is configured to face a tip of a rotor blade 56 and a tip clearance G is formed therebetween, such that the leakage from the gas flow path 12 within the compressor casing 30 flows through a leakage path defined by the first body 326 and the first flange 320 of the first segment, the second body 344 and the second flange 342 of the second segment 34, and the first and the second annular leak-resistant plates 40,42, and leakage through the first and the second sets of stress-relief holes 3204, 3424 is prevented by the first and the second annular leak-resistant plates 40,42.

Figure 5:
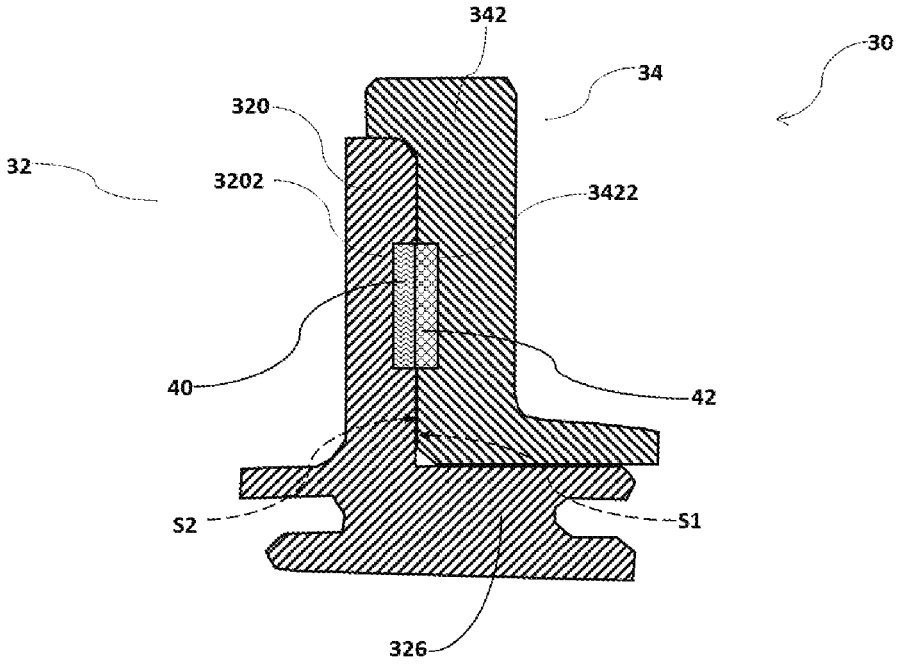

FIGS. 3-5 are enlarged half-sectional views of the casing joint C (more specifically formed as a bolted joint) of the compressor casing shown in FIG. 2, taken at the same axial positions and at different circumferential positions respectively relative to the longitudinal axis 11. The casing joint shown in FIG. 3 is taken at the circumferential position where one of the aligned first or the second or the third or the fourth sets of mounting holes 3200, 3420, 400 and 420 is located, and the fastener 44 in the form of bolt is directed into the aligned mounting holes 3200, 3420, 400 and 420 until the bolt head touches or contacts with an upstream annular side face of the first flange 320 opposite to the annular side mating face S1 of the first flange 320, and a corresponding nut (not shown) may be connected with the fastener 44.

The plurality of fasteners 44 comprise a plurality of threaded fasteners each comprising a threaded outer surface, and each mounting hole of the first, the second, the third and the fourth sets of mounting holes 3200, 3420, 400 and 420 has a threaded inner surface, the plurality of threaded fasteners 44 are threaded into the first, the second, the third and the fourth sets of mounting holes 3200, 3420, 400 and 420 during assembly, such that leakage from the gas flow path is prevented from flowing through the first, the second, the third and the fourth sets of mounting holes 3200, 3420, 400 and 420.

For ensuring reliability of connecting and sealing between the first flange 320 and the second flange 342, the first and the second annular leak-resistant plates 40, 42 are configured to form an interference fit within the first annular recess 3202 and the second annular recess 3422, the interference fit between the plates 40, 42 and the first flange 320 and the second flange 342 may be achieved by size mismatch or by material difference. The annular leak-resistant plate(s) and the first segment 320 and the second segment 342 may be made of same or different materials, the size of the annular leak-resistant plate(s) may be bigger than that of the corresponding annular recess, thus the annular leak-resistant plate(s) may be mounted into the corresponding annular recess by cooling the former or heating the latter during assembly, thus the interference fit is formed therebetween and may be enforced due to different material during operation.

When the annular leak-resistant plate(s) and the first segment and the second segment are made of different materials, for example, the first segment and the second segment is made of a first material, and the annular leak-resistant plate is made of a second material having a different coefficient of thermal expansion with that of the first material. The size of the annular leak-resistant plate is equal to or a little bigger than that of the corresponding annular recess, thus the annular leak-resistant plate is easily mounted into the corresponding annular recess basically under the normal assembly temperature, during operation, the interference fit between the plates and the first flange and the second flange may be achieved due to the different material expending at the same operation temperature.

The casing joint shown in FIG. 4 is taken at the circumferential position where the first and the second sets of stress-relief holes 3204, 3424 are located. As illustrated in FIG. 4, the first set of stress-relief holes 3204 and the second set of stress-relief holes 3424 are at least partly aligned with each other and formed axially respectively and parallel to the first and the second sets of mounting holes 3200, 3420, the first and the second sets of stress-relief holes 3204, 3424 may dislocate or mismatch with each other and needn't align with each other. The first and the second annular leak-resistant plates 40, 42 are configured to abut against each other and be clamped between the first flange 320 and the second flange 342 via the interference fit retained through operation of the compressor, thus the first set of stress-relief holes 3204 and the first set of stress-relief holes 3424 are respectively covered by the first and the second annular leak-resistant plates 40, 42, and the leakage is prevented from the gas flow path 12 of the compressor through an interface between the first body 326 of the first segment 32 and the second body 344 of the second segment 34, through a lower part interface between the first flange of the first segment and the second flange of the second segment, and around and between the first and the second annular leak-resistant plates 40, 42 and through the first and the second set of stress-relief holes 3204, 3424.

Figure 6:
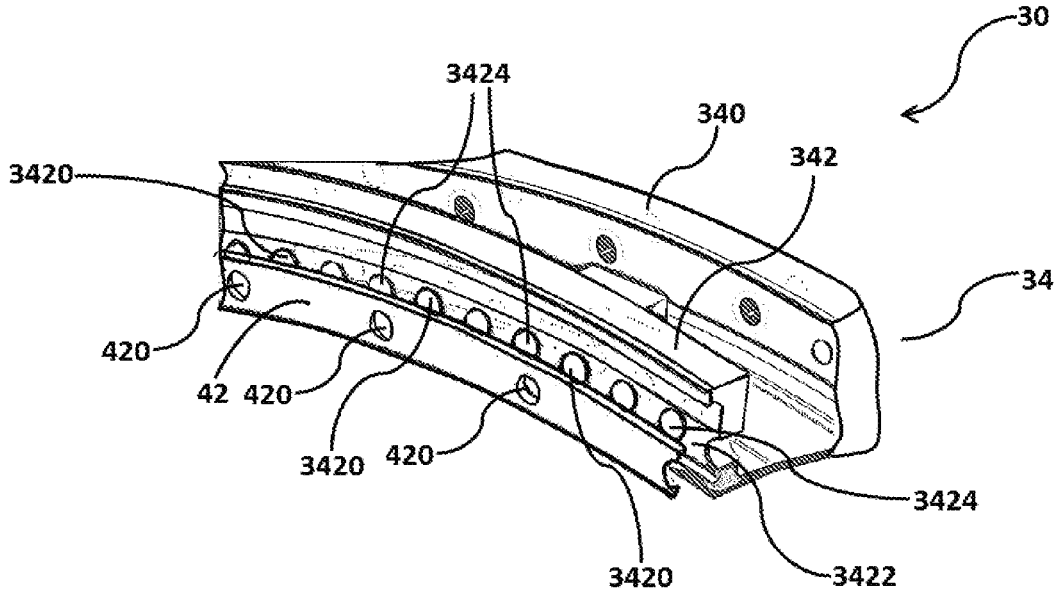
FIG. 6 is a schematic partial exploded perspective view of the casing joint C shown in FIG. 2, in accordance with an embodiment of the disclosure.

FIG. 6 shows a partial perspective view of the exemplary second compressor annular casing segment 34 and a second annular leak-resistant plate 42 of the casing joint C shown in FIG. 2. As shown in FIG. 6, the second flange 342 of the second segment 34 comprises the second set of mounting holes 3420 and the second set of stress-relief holes 3424, and adjacent two mounting holes 3420 of the second set of mounting holes 3420 are circumferentially spaced apart by two stress-relief holes 3424 of the second set of stress-relief holes 3424. In other embodiments, the number of stress-relief holes between adjacent two mounting holes may be varied based on practical or manufacture or operation condition or other concerns. The second annular leak-resistant plate 42 may be an integral annular leak-resistant plate integrally manufactured by traditional casting or cutting and drilling process and so on. The second annular leak-resistant plate 42 may selectively be a combined annular leak-resistant plate as shown in FIG. 7.

Figure 7:
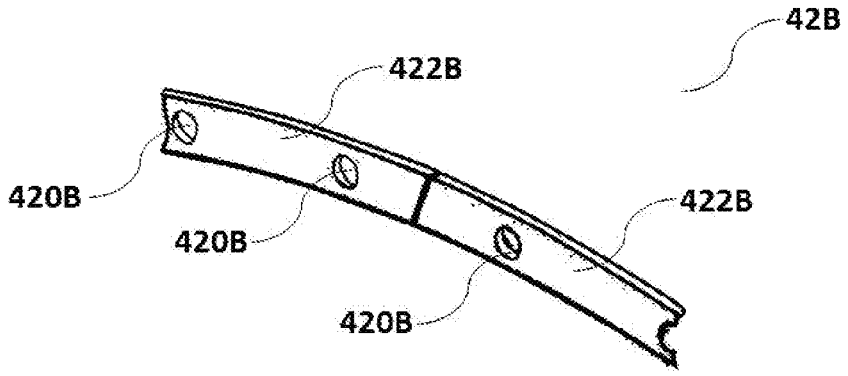
FIG. 7 is a schematic partial perspective view of a second annular leak-resistant plate of the casing joint C shown in FIG. 2, in accordance with an embodiment of the disclosure.

As illustrated in FIG. 7, an exemplary annular leak-resistant plate 42B may be a combined annular leak-resistant plate, and the one combined annular leak-resistant plate 42B consists of a plurality of sector portions 422B securely and seamlessly connected together via welded joints, brazed joints or any other kind of joints that one person skilled in the art could conceive. Each of the plurality of sector portions 422B comprises one or more mounting holes 420B based on the other design configuration or requirements and other operation conditions.

FIG. 8 shows a schematic, half-sectional exploded view of a casing joint of the compressor casing similar to FIGS. 2-5, in accordance with another embodiment of the disclosure; FIGS. 9 and 10 show a schematic, half-sectional view of the casing joint of the compressor casing shown in FIG. 8, which are taken at different circumferential positions. As illustrated in FIGS. 8-10, the casing joint of the compressor casing comprises only one first annular recess 3422A formed on an annular side mating face S2 of the second flange 342A of the second segment 34A, and the first annular recess 3422A has an open end 3426A at a radially utmost inside of the second flange 342A and configured to receive the first and the second annular leak-resistant plates 40A, 42A and at least part of the first flange 320 of the first segment 32.

As illustrated in FIGS. 9 and 10, the first and the second annular leak-resistant plates 40A, 42A are clamped between the first flange 320 of the first segment 32 and the second flange 342A of the second segment 34A via an interference fit retained through operation of the compressor. The interference fit may be achieved by material difference between the first and the second annular leak-resistant plates 40A, 42A and the first segment 32 and the second segment 34A. In other embodiments, the single first annular recess of the casing joint may be selectively formed on an annular side mating face of the first flange of the first segment rather than on the second flange of the second segment.

As illustrated in FIG. 10, the casing joint of the compressor casing 30A comprises only one set of stress-relief holes 3204 extending through the first flange 320 of the first segment 32, the second flange 342A hasn't any stress-relief holes since the set of stress-relief holes 3204 can meet hoop stress requirements. In other embodiments, the second flange 342A may comprise less stress-relief holes than the first segment 32. Once the fasteners 44 pass through the first and the second and the third and the fourth sets of mounting holes 3200, 3420A, 400A and 420A and reach the position as shown in FIG. 9, further having nuts connected to. The first and the second annular leak-resistant plates 40A, 42A are configured to abut against each other via the interference fit retained through operation due to thermal expanding difference, thus the first and the second annular leak-resistant plates 40A, 42A are pressed or pushed to cover or seal the first set of stress-relief holes 3204 for preventing or blocking the corresponding leakage.

Once the annular outer wall 50 and the compressor rotor 52 and rotor blades 56 are appropriately mounted in position shown in FIG. 2, the compressor casing 30 as previous illustration and description may be mounted or assembled by machines and/or operators along the gas flow path 12, such as from upstream to downstream; the second flange 322 of the first segment 32 is firstly secured or mounted on the annular out wall 50 with any traditional connecting devices, such as bolts or screws and so on. Since the second flange 322 is at lower temperature than the first flange 320 thus the second flange 322 may not comprise any stress-relief hole, thus a corresponding casing joint of the second flange 322 is unnecessary to involve any annular recess or leak-resistant plate. In other embodiments, the second flange 322 may be configured to be the casing joint shown in FIG. 2.

The first flange 320 of the first segment 32 and the second flange 342 of the second segment are exemplarily in the form of the casing joint C shown in FIG. 2 due to higher temperature. During assembly, the first and the second annular leak-resistant plates 40 and 42 are placed or set within the first and the second annular recesses 3202, 3422, respectively. The first and the second annular leak-resistant plates 40 and 42 are configured to be bigger than the first and the second annular recesses 3202, 3422 thus the interference fit is formed therebetween and retained through operation of the compressor. The interference fit therebetween may be achieved and retained by material difference and the resultant expending difference at high temperature during operation as described above.

The second segment 34 is then moved toward the first segment 32 until the second flange 342 approaches the first flange 320, then the first and the second and the third and the fourth sets of mounting holes 3200, 3420, 400, 420 are adjusted to align with each other, and the plurality of fasteners 44 are respectively directed or threaded through mounting holes 3200, 3420, 400, 420, then the respective nuts or screw caps (not shown) are connected to a free end of the fasteners 44, thus the first and the second annular leak-resistant plates 40 and 42 are clamped to abut against each other and pressed towards a bottom wall of the respective recess 3202, 3422 for sealing. Simultaneously the first flange of the first segment and the second flange of the second segment except the recess area are clamped to abut against each other, thus leakage through the first and the second set of stress-relief holes 3204, 3424 are substantially prevented due to enhanced clamped force and the interference fit. The leakage from the flow path 12 through the interface between the first segment 32 and the second segment 34 is also decreased or eliminated by the first and the second annular leak-resistant plates 40 and 42. When the compressor casing 30 is appropriately assembled or mounted, the stator vanes 54,58 may be installed in the corresponding grooves formed within the first bodies of the casing segments.

Figure 11:
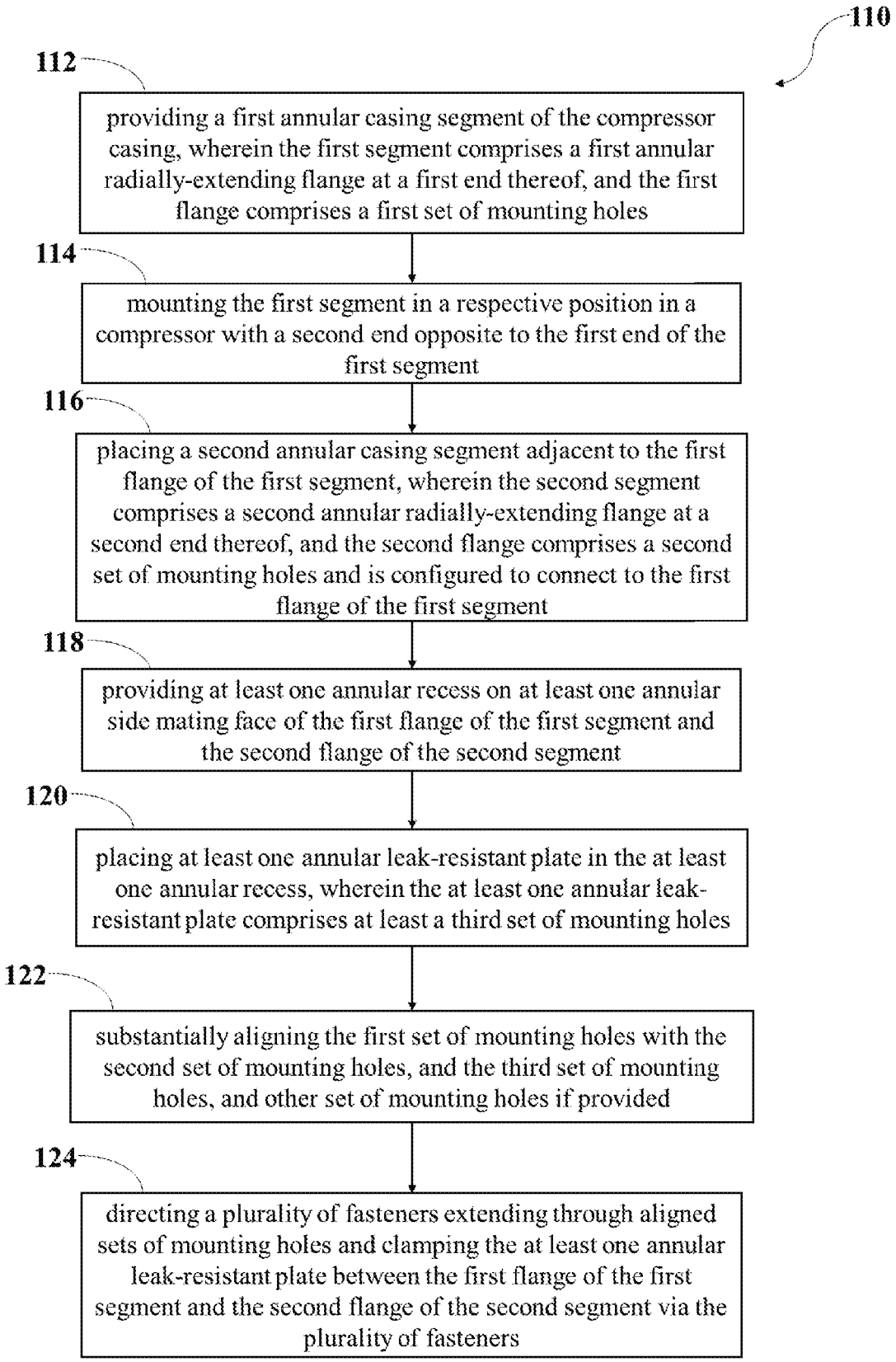
FIG. 11 is a flow chart illustrating a method of assembling a compressor casing in accordance with an embodiment of the disclosure.

FIG. 11 illustrates an exemplary embodiment of a method 110 of assembling a compressor casing, the compressor casing may be shown in FIGS. 2-10 and other similar compressor casings. Method 110 may be performed or carried out by a controller (such as an assembly controller) and corresponding machine, such as assembling mechanical arms, operators may be involved in one or more steps.

The method 110 begins at step 112 by providing a first annular casing segment of the compressor casing, wherein the first segment comprises a first annular radially-extending flange at a first end thereof, and the first flange comprises a first set of mounting holes. The first annular casing segment and its specific components or structure or configuration may be understood by referring to FIGS. 2-5,8-10 and above descriptions.

The method 110 further comprises mounting the first segment in a respective position in a compressor with a second end opposite to the first end of the first segment at step 114. The second flange of the first segment is secured or mounted specifically on the annular out wall or other compressor casing segment with any traditional connecting devices, such as bolts or screws and so on. For simplifying description, the second flange of the first segment doesn't use or involve any stress-relief hole and annular leak-resistant plate. In other embodiments, the second flange of the first segment may be configured to be the casing joint shown in FIG. 2.

The method 110 further comprises placing a second annular casing segment adjacent to the first flange of the first segment at step 116, wherein the second segment comprises a second annular radially-extending flange at a second end thereof, and the second flange comprises a second set of mounting holes and is configured to connect to the first flange of the first segment. The second segment and its specific components or structure or configuration may be understood by referring to FIGS. 2-6, 8-10 and above descriptions.

The method 110 further comprises providing at least one annular recess on at least one annular side mating face of the first flange of the first segment and the second flange of the second segment at step 118. One of or both of the first flange of the first segment and the second flange of the second segment may be formed or provided with an annular recess, the specific number of the recess depends on the actual requirements and operation conditions. As shown in FIGS. 2-5, the first flange 320 and the adjacent second flange 342 may be both formed with the respective recess. As shown in FIGS. 7-8, only the second flange 342 of the casing joint has the respective recess on an annular side mating face.

The method 110 further comprises placing at least one annular leak-resistant plate in the at least one annular recess, wherein the at least one annular leak-resistant plate comprises at least a third set of mounting holes at step 120. One or two or more than two annular leak-resistant plates may be selectively provided for setting within one or more annular recesses, the specific number of the plate depends on the actual requirements and operation conditions. As shown in FIGS. 2-5, the casing joint C including the first flange 320 and the adjacent second flange 342 comprises two annular leak-resistant plates, i.e. the first and the second annular leak-resistant plates 40, 42. In other embodiments, the casing joint C may comprise only one or single annular leak-resistant plate, namely two opposite portion of the single annular leak-resistant plate may be disposed with the first and the second annular recesses shown in FIG. 2, respectively.

The method 110 further comprises substantially aligning the first set of mounting holes with the second set of mounting holes, and the third set of mounting holes, and other set of mounting holes if provided at step 122, namely aligning all related sets of mounting holes disposed through the first flange of the first segment, and the second flange of the second segment, one or more annular leak-resistant plates.

The method 110 further comprises directing a plurality of fasteners extending through aligned sets of mounting holes and clamping the at least one annular leak-resistant plate between the first flange of the first segment and the second flange of the second segment via the plurality of fasteners at step 124. That is to say, the fasteners pass or extend through the first and the second and the third sets of mounting holes, and other set of mounting holes if provided.

At step 124, the at least one annular leak-resistant plate is clamped to abut against each other and against corresponding recess walls and seal the at least one set of stress-relief holes, thus leakage from a gas flow path within the compressor casing through the at least one set of stress-relief holes is substantially prevented or blocked by the at least one annular leak-resistant plate. As illustrated in FIG. 4, two sets of stress-relief holes are disposed through the first flange of the first segment and the second flange of the second segment, respectively. As illustrated in FIG. 10, only one set of stress-relief holes may be disposed through the first flange of the first segment.

The method 110 can repeat the steps 112 to 124 until all annular casing segments of the compressor casing are mounted or assembled in position.

Various embodiments achieve the improved cyclic life of the mounting holes or bolt holes or casing joints without affecting the corresponding blade tip clearances. This also allows maintaining the Specific Fuel Consumption (SFC).

In one embodiment, a compressor casing comprises: a first annular casing segment comprising a first annular radially-extending flange at a first end thereof, and the first flange comprising a first set of mounting holes; a second annular casing segment adjacent to the first segment comprising a second annular radially-extending flange at a second end thereof, and the second flange comprising a second set of mounting holes and configured to connect to the first flange of the first segment during assembly; at least one annular recess disposed on at least one annular side mating face of the first flange of the first segment and the second flange of the second segment; at least one set of stress-relief holes disposed through at least one of the first flange of the first segment and the second flange of the second segment; and at least one annular leak-resistant plate configured to be disposed within the at least one annular recess, and the at least one annular leak-resistant plate comprising at least a third set of mounting holes; wherein the first set of mounting holes, the second set of mounting holes, and the at least the third set of mounting holes are configured to be substantially aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus prevents leakage from a gas flow path within the compressor casing through the at least one set of stress-relief holes.

In one example, the at least one annular recess comprises a first annular recess and a second annular recess, and the first annular recess is formed on an annular side mating face of the first flange of the first segment, and the second annular recess is formed on an annular side mating face of the second flange of the second segment, and wherein the at least one annular leak-resistant plate is configured to be disposed within the first annular recess and the second annular recess and clamped between the first flange of the first segment and the second flange of the second segment via an interference fit retained through operation of the compressor.

In one example, the at least one annular leak-resistant plate comprises a first annular leak-resistant plate and a second annular leak-resistant plate configured to be respectively disposed within the first annular recess and the second annular recess, and wherein the first and the second annular leak-resistant plates are configured to abut against each other and be clamped between the first flange of the first segment and the second flange of the second segment via the interference fit retained through operation of the compressor.

In one example, the at least one set of stress-relief holes comprises a first set of stress-relief holes disposed through one of the first flange of the first segment and the second flange of the second segment, and one or more stress-relief holes of the first set of stress-relief holes are circumferentially spaced apart by one or more mounting holes.

In one example, the at least one set of stress-relief holes further comprise a second set of stress-relief holes disposed through the other of the first flange of the first segment and the second flange of the second segment, and one or more stress-relief holes of the second set of stress-relief holes are circumferentially spaced apart by one or more mounting holes.

In one example, the at least one annular recess comprises a first annular recess formed on an annular side mating face of the second flange of the second segment, and the first annular recess has an open end at a radially utmost inside of the second flange and configured to receive the at least one annular leak-resistant plate and at least part of the first flange of the first segment, wherein the at least one annular leak-resistant plate is clamped between the first flange of the first segment and the second flange of the second segment via an interference fit retained through operation of the compressor.

In one example, the at least one annular leak-resistant plate comprises at least one integral annular leak-resistant plate or at least one combined annular leak-resistant plate, and the at least one combined annular leak-resistant plate consists of a plurality of sector portions.

In one example, the at least one annular leak-resistant plate is made of a first material, and the first segment and the second segment are made of a second material or the first material, and a coefficient of thermal expansion of the second material is different from that of the first material.

In one example, the plurality of fasteners comprises a plurality of threaded fasteners each comprising a threaded outer surface, and each of the first set of mounting holes and the second set of mounting holes and the third set of mounting holes has a threaded inner surface, the plurality of threaded fasteners are threaded into the first set of mounting holes and the second set of mounting holes and the third set of mounting holes during assembly, such that leakage from the gas flow path is prevented from flowing through the first set of mounting holes and the second set of mounting holes and the third set of mounting holes.

In one example, the first segment comprises a first annular axially-extending body extending away from the first end thereof, and the second segment comprises a second annular axially-extending body at the second end thereof, and the first body of the first segment is disposed radially inside of and contacts with the second body of the second segment during operation, and the first body of the first segment is configured to face a tip of a rotor blade and defines a tip clearance therebetween, such that the leakage from the flow path flows through a leakage path defined by the first body and the first flange of the first segment, the second body and the second flange of the second segment, and the at least one annular leak-resistant plate.

In another embodiment, a gas turbine engine apparatus comprises a compressor, a combustor, and a turbine arranged in serial flow relationship, wherein the compressor comprises an annular compressor casing. The annular compressor casing comprises: a first annular casing segment comprising a first annular radially-extending flange at a first end thereof, and the first flange comprising a first set of mounting holes; a second annular casing segment adjacent to the first segment comprising a second annular radially-extending flange at a second end thereof, and the second flange comprising a second set of mounting holes and configured to connect to the first flange of the first segment during assembly; at least one annular recess disposed on at least one annular side mating face of the first flange of the first segment and the second flange of the second segment; at least one set of stress-relief holes disposed through at least one of the first flange of the first segment and the second flange of the second segment; and at least one annular leak-resistant plate configured to be disposed within the at least one annular recess, and the at least one annular leak-resistant plate comprising at least a third set of mounting holes; wherein the first set of mounting holes, the second set of mounting holes, and the at least the third set of mounting holes are configured to be substantially aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus prevents leakage from a gas flow path within the compressor casing through the at least one set of stress-relief holes.

In one example, the at least one annular recess comprises a first annular recess and a second annular recess, and the first annular recess is formed on an annular side mating face of the first flange of the first segment, and the second annular recess is formed on an annular side mating face of the second flange of the second segment, and the at least one annular leak-resistant plate is configured to be disposed within the first annular recess and the second annular recess and clamped between the first flange of the first segment and the second flange of the second segment via an interference fit retained through operation of the compressor.

In one example, the at least one annular leak-resistant plate comprises a first annular leak-resistant plate and a second annular leak-resistant plate configured to be respectively disposed within the first annular recess and the second annular recess, and wherein the first and the second annular leak-resistant plates are configured to abut against each other and be clamped between the first flange of the first segment and the second flange of the second segment via the interference fit retained through operation of the compressor.

In one example, the at least one set of stress-relief holes comprises a first set of stress-relief holes disposed through the first flange of the first segment and/or a second set of stress-relief holes disposed through the second flange of the second segment, and one or more stress-relief holes of the first set of stress-relief holes or the second set of stress-relief holes are circumferentially spaced apart by one or more mounting holes of the first set of mounting holes or the second set of mounting holes, respectively.

In one example, the at least one annular recess comprises a first annular recess formed on an annular side mating face of the second flange of the second segment, and the first annular recess has an open end at a radially inside end of the second flange and configured to receive the at least one annular leak-resistant plate and at least part of the first flange of the first segment, wherein the at least one annular leak-resistant plate is clamped between the first flange of the first segment and the second flange of the second segment via an interference fit retained through operation of the compressor.

In one example, the at least one annular leak-resistant plate is made of a first material, and the first segment and the second segment are made of a second material or the first material, and a coefficient of thermal expansion of the second material is different from that of the first material.

In one example, the plurality of fasteners comprises a plurality of threaded fasteners each comprising a threaded outer surface, and each of the first set of mounting holes and the second set of mounting holes and the third set of mounting holes has a threaded inner surface, the plurality of threaded fasteners are threaded into the first set of mounting holes and the second set of mounting holes and the at least the third set of mounting holes during assembly, such that leakage is prevented from flowing through the first set of mounting holes and the second set of mounting holes and the third set of mounting holes.

In one example, the first segment comprises a first annular axially-extending body extending away from the first end thereof, and the second segment comprises a second annular axially-extending body at the second end thereof, and the first body of the first segment is disposed radially inside of and contacts with the second body of the second segment during operation, and the first body is configured to face a tip of a rotor blade and defines a tip clearance therebetween, such that the leakage from the gas flow path flows through a leakage path defined by the first body and the first flange of the first segment, the second body and the second flange of the second casing, and the at least one annular leak-resistant plate.

In one example, the first set of mounting holes, the second set of mounting holes, the at least the third set of mounting holes and at least one set of stress-relief holes are substantially symmetrical about a longitudinal axis of the compressor during operation, respectively.

In another embodiment, a method of assembling a compressor casing comprises: providing a first annular casing segment of the compressor casing, wherein the first segment comprises a first annular radially-extending flange at a first end thereof, and the first flange comprises a first set of mounting holes; mounting the first segment in a respective position in a compressor with a second end opposite to the first end of the first segment; placing a second annular casing segment adjacent to the first flange of the first segment, wherein the second segment comprises a second annular radially-extending flange at a second end thereof, and the second flange comprises a second set of mounting holes and is configured to connect to the first flange of the first segment; providing at least one annular recess on at least one annular side mating face of the first flange of the first segment and the second flange of the second segment; placing at least one annular leak-resistant plate in the at least one annular recess, wherein the at least one annular leak-resistant plate comprises at least a third set of mounting holes; and substantially aligning the first set of mounting holes with the second set of mounting holes, and the at least the third set of mounting holes, and directing a plurality of fasteners axially extending therethrough, and clamping the at least one annular leak-resistant plate between the first flange of the first segment and the second flange of the second segment via the plurality of fasteners; wherein at least one set of stress-relief holes are disposed through at least one of the first flange of the first segment and the second flange of the second segment, and the at least one annular leak-resistant plate is configured to seal the at least one set of stress-relief holes, thus prevents leakage from a gas flow path within the compressor casing through the at least one set of stress-relief holes.

As used herein, the terms "first," "second," and "third" may be used interchangeably to distinguish one component from another and are not intended to signify location or importance of the individual components. The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The disclosure herein is not restricted to the details of the foregoing embodiment(s). The disclosure herein extends to any novel one, or any novel combination, of the features disclosed in this specification (including any accompanying claims, abstract and drawings), or to any novel one, or any novel combination, of the steps of any method or process so disclosed.

What is claimed is:

1. A compressor casing, comprising:

a first annular casing segment comprising a first annular radially-extending flange at a first end thereof, and the first flange comprising a first set of mounting holes;

a second annular casing segment adjacent to the first segment comprising a second annular radially-extending flange at a second end thereof, and the second flange comprising a second set of mounting holes and configured to connect to the first flange of the first segment during assembly;

at least one annular recess disposed on at least one annular side mating face of the first flange of the first segment and the second flange of the second segment, the at least one annular recess comprising a first annular recess and a second annular recess, the first annular recess formed on an annular side mating face of the first flange of the first segment, and the second annular recess formed on an annular side mating face of the second flange of the second segment;

at least one set of stress-relief holes disposed through at least one of the first flange of the first segment and the second flange of the second segment; and at least one annular leak-resistant plate configured to be disposed within the at least one annular recess, and the at least one annular leak-resistant plate comprising at least a third set of mounting holes, the at least one annular leak-resistant plate configured to be disposed within the first annular recess and the second annular recess and clamped between the first flange of the first segment and the second flange of the second segment via an interference fit retained through operation of the compressor, the at least one annular leak-resistant plate comprising a first annular leak-resistant plate and a second annular leak-resistant plate configured to be respectively disposed within the first annular recess and the second annular recess, the first annular leak-resistant plate comprising the third set of mounting holes extending therethrough, and the second annular leak-resistant plate comprising a fourth set of mounting holes extending therethrough, wherein the first and the second annular leak-resistant plates are configured to abut against each other and be clamped between the first flange of the first segment and the second flange of the second segment via the interference fit retained through operation of the compressor, and wherein the first set of mounting holes, the second set of mounting holes, and the at least the third set of mounting holes are configured to be substantially aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus preventing leakage from a gas flow path within the compressor casing through the at least one set of stress-relief holes.

2. The compressor casing of claim 1, wherein the at least one set of stress-relief holes comprises a first set of stress-relief holes disposed through one of the first flange of the first segment and the second flange of the second segment, and one or more stress-relief holes of the first set of stress-relief holes are circumferentially spaced apart by one or more mounting holes.

3. The compressor casing of claim 2, wherein the at least one set of stress-relief holes further comprise a second set of stress-relief holes disposed through the other of the first flange of the first segment and the second flange of the second segment, and one or more stress-relief holes of the second set of stress-relief holes are circumferentially spaced apart by one or more mounting holes.

4. The compressor casing of claim 1, wherein the at least one annular recess comprises a first annular recess formed on an annular side mating face of the second flange of the second segment, and the first annular recess has an open end at a radially utmost inside of the second flange and configured to receive the at least one annular leak-resistant plate and at least part of the first flange of the first segment, wherein the at least one annular leak-resistant plate is clamped between the first flange of the first segment and the second flange of the second segment via an interference fit retained through operation of the compressor.

5. The compressor casing of claim 1, wherein the at least one annular leak-resistant plate comprises at least one integral annular leak-resistant plate or at least one combined annular leak-resistant plate, and the at least one combined annular leak-resistant plate consists of a plurality of sector portions.

6. The compressor casing of claim 1, wherein the at least one annular leak-resistant plate is made of a first material, and the first segment and the second segment are made of a second material or the first material, and a coefficient of thermal expansion of the second material is different from that of the first material.

7. The compressor casing of claim 1, wherein the plurality of fasteners comprises a plurality of threaded fasteners each comprising a threaded outer surface, and each of the first set of mounting holes and the second set of mounting holes and the at least the third set of mounting holes has a threaded inner surface, the plurality of threaded fasteners are threaded into the first set of mounting holes and the second set of mounting holes and the at least the third set of mounting holes during assembly, such that leakage from the gas flow path is prevented from flowing through the first set of mounting holes and the second set of mounting holes and the at least the third set of mounting holes.

8. The compressor casing of claim 1, wherein the first segment comprises a first annular axially-extending body extending away from the first end thereof, and the second segment comprises a second annular axially-extending body at the second end thereof, and the first body of the first segment is disposed radially inside of and contacts with the second body of the second segment during operation, and the first body of the first segment is configured to face a tip of a rotor blade and defines a tip clearance therebetween, such that the leakage from the flow path flows through a leakage path defined by the first body and the first flange of the first segment, the second body and the second flange of the second segment, and the at least one annular leak-resistant plate.

9. A gas turbine engine apparatus, comprising:

a compressor, a combustor, and a turbine arranged in serial flow relationship, wherein the compressor comprises:

an annular compressor casing, comprising:

a first annular casing segment comprising a first annular radially-extending flange at a first end thereof, and the first flange comprising a first set of mounting holes;

a second annular casing segment adjacent to the first segment comprising a second annular radially-extending flange at a second end thereof, and the second flange comprising a second set of mounting holes and configured to connect to the first flange of the first segment during assembly;

at least one annular recess disposed on at least one annular side mating face of the first flange of the first segment and the second flange of the second segment, the at least one annular recess comprising a first annular recess and a second annular recess, the first annular recess formed on an annular side mating face of the first flange of the first segment, and the second annular recess formed on an annular side mating face of the second flange of the second segment;

at least one set of stress-relief holes disposed through at least one of the first flange of the first segment and the second flange of the second segment; and at least one annular leak-resistant plate configured to be disposed within the at least one annular recess, and the at least one annular leak-resistant plate comprising at least a third set of mounting holes, the at least one annular leak-resistant plate configured to be disposed within the first annular recess and the second annular recess and clamped between the first flange of the first segment and the second flange of the second segment via an interference fit retained through operation of the compressor, the at least one annular leak-resistant plate comprising a first annular leak-resistant plate and a second annular leak-resistant plate configured to be respectively disposed within the first annular recess and the second annular recess, the first annular leak-resistant plate comprising the third set of mounting holes extending therethrough, and the second annular leak-resistant plate comprising a fourth set of mounting holes extending therethrough, wherein the first and the second annular leak-resistant plates are configured to abut against each other and be clamped between the first flange of the first segment and the second flange of the second segment via the interference fit retained through operation of the compressor, and wherein the first set of mounting holes, the second set of mounting holes, and the at least the third set of mounting holes are configured to be substantially aligned with each other and receive a plurality of respective fasteners axially extending therethrough during assembly, and the at least one annular leak-resistant plate is clamped between the first flange of the first segment and the second flange of the second segment by the plurality of fasteners and configured to seal the at least one set of stress-relief holes, thus prevents leakage from a gas flow path within the compressor casing through the at least one set of stress-relief holes.

10. The apparatus of claim 9, wherein the at least one set of stress-relief holes comprises a first set of stress-relief holes disposed through the first flange of the first segment and a second set of stress-relief holes disposed through the second flange of the second segment, and one or more stress-relief holes of the first set of stress-relief holes or the second set of stress-relief holes are circumferentially spaced apart by one or more mounting holes of the first set of mounting holes or the second set of mounting holes, respectively.

11. The apparatus of claim 9, wherein the at least one annular recess comprises a first annular recess formed on an annular side mating face of the second flange of the second segment, and the first annular recess has an open end at a radially inside end of the second flange and configured to receive the at least one annular leak-resistant plate and at least part of the first flange of the first segment, wherein the at least one annular leak-resistant plate is clamped between the first flange of the first segment and the second flange of the second segment via an interference fit retained through operation of the compressor.

12. The apparatus of claim 9, wherein the at least one annular leak-resistant plate is made of a first material, and the first segment and the second segment are made of a second material or the first material, and a coefficient of thermal expansion of the second material is different from that of the first material.

13. The apparatus of claim 9, wherein the plurality of fasteners comprises a plurality of threaded fasteners each comprising a threaded outer surface, and each of the first set of mounting holes and the second set of mounting holes and the at least the third set of mounting holes has a threaded inner surface, the plurality of threaded fasteners are threaded into the first set of mounting holes and the second set of mounting holes and the at least the third set of mounting holes during assembly, such that leakage is prevented from flowing through the first set of mounting holes and the second set of mounting holes and the at least the third set of mounting holes.

14. The apparatus of claim 9, wherein the first set of mounting holes, the second set of mounting holes, the at least the third set of mounting holes and at least one set of stress-relief holes are substantially symmetrical about a longitudinal axis of the compressor during operation, respectively.

15. A method of assembling a compressor casing, the method comprising:

providing a first annular casing segment of the compressor casing, wherein the first segment comprises a first annular radially-extending flange at a first end thereof, and the first flange comprises a first set of mounting holes;

mounting the first segment in a respective position in a compressor with a second end opposite to the first end of the first segment;

placing a second annular casing segment adjacent to the first flange of the first segment, wherein the second segment comprises a second annular radially-extending flange at a second end thereof, and the second flange comprises a second set of mounting holes and is configured to connect to the first flange of the first segment;

providing at least one annular recess on at least one annular side mating face of the first flange of the first segment and the second flange of the second segment the at least one annular recess comprising a first annular recess and a second annular recess, the first annular recess formed on an annular side mating face of the first flange of the first segment, and the second annular recess formed on an annular side mating face of the second flange of the second segment;

placing at least one annular leak-resistant plate in the at least one annular recess, wherein the at least one annular leak-resistant plate comprises at least a third set of mounting holes, the at least one annular leak-resistant plate configured to be disposed within the first annular recess and the second annular recess and clamped between the first flange of the first segment and the second flange of the second segment via an interference fit retained through operation of the compressor, the at least one annular leak-resistant plate comprising a first annular leak-resistant plate and a second annular leak-resistant plate configured to be respectively disposed within the first annular recess and the second annular recess, the first annular leak-resistant plate comprising the third set of mounting holes extending therethrough, and the second annular leak-resistant plate comprising a fourth set of mounting holes extending therethrough, the first and the second annular leak-resistant plates are configured to abut against each other and be clamped between the first flange of the first segment and the second flange of the second segment via the interference fit retained through operation of the compressor; and substantially aligning the first set of mounting holes with the second set of mounting holes, and the at least the third set of mounting holes, and directing a plurality of fasteners axially extending therethrough, and clamping the at least one annular leak-resistant plate between the first flange of the first segment and the second flange of the second segment via the plurality of fasteners;

wherein at least one set of stress-relief holes are disposed through at least one of the first flange of the first segment and the second flange of the second segment, and the at least one annular leak-resistant plate is configured to seal the at least one set of stress-relief holes, thus prevents preventing leakage from a gas flow path within the compressor casing through the at least one set of stress-relief holes.

* * * * *